US011358295B2

(12) United States Patent
Hubert et al.

(10) Patent No.: US 11,358,295 B2
(45) Date of Patent: Jun. 14, 2022

(54) METHOD FOR OPTIMIZING A SHEARING BENCH AND ASSOCIATED SHEARING BENCH

(71) Applicant: ARMOR, Nantes (FR)

(72) Inventors: Gildas Hubert, Saint Etienne de Montluc (FR); Paul Calvez, La Chapelle sur Erdre (FR); Frédéric Thepaut, Saint Philibert de Grand Lieu (FR); Christophe Derennes, Saint Philbert de Grand Lieu (FR)

(73) Assignee: ARMOR, Nantes (FR)

( * ) Notice: Subject to any disclaimer, the term of this patent is extended or adjusted under 35 U.S.C. 154(b) by 0 days.

(21) Appl. No.: 17/059,853

(22) PCT Filed: May 31, 2019

(86) PCT No.: PCT/EP2019/064166
§ 371 (c)(1),
(2) Date: Nov. 30, 2020

(87) PCT Pub. No.: WO2019/229226
PCT Pub. Date: Dec. 5, 2019

(65) Prior Publication Data

US 2021/0213636 A1 Jul. 15, 2021

(30) Foreign Application Priority Data

Jun. 1, 2018 (FR) ..... 18 54761

(51) Int. Cl.
*B26D 5/00* (2006.01)
*B26D 1/15* (2006.01)

(52) U.S. Cl.
CPC ..... *B26D 5/005* (2013.01); *B26D 1/151* (2013.01); *B26D 5/007* (2013.01)

(58) Field of Classification Search
CPC ..... B26D 1/151; B26D 5/00; B26D 5/005; B26D 5/007
See application file for complete search history.

(56) References Cited

U.S. PATENT DOCUMENTS 6,159,579 A * 12/2000 Mizutani ..... C08J 5/18 428/141
6,994,290 B2 * 2/2006 Ito ..... B65H 18/103 242/530

(Continued)

FOREIGN PATENT DOCUMENTS

DE 19524519 A1 * 1/1997 ..... B02C 18/18
JP S52101100 U 8/1977

(Continued)

OTHER PUBLICATIONS

Search Report for French Application No. 18 54761 dated Feb. 19, 2019.

(Continued)

*Primary Examiner* — Stephen Choi
(74) *Attorney, Agent, or Firm* — Pearne & Gordon LLP

(57) ABSTRACT

The invention relates to a method for optimizing a shearing bench for shearing a film having a thickness less than or equal to 10 microns, the shearing bench comprising a plurality of elements, each element being characterized by a plurality of parameters, the collection of parameters forming the parameters of the shearing bench, the plurality of elements comprising at least one blade assembly comprising a blade and a counter-blade collaborating with the blade, a system for progressing the film, and a system for urging the blade and the counter-blade against one another in order to shear the film.

11 Claims, 2 Drawing Sheets

(56) References Cited

U.S. PATENT DOCUMENTS

Figure 1:
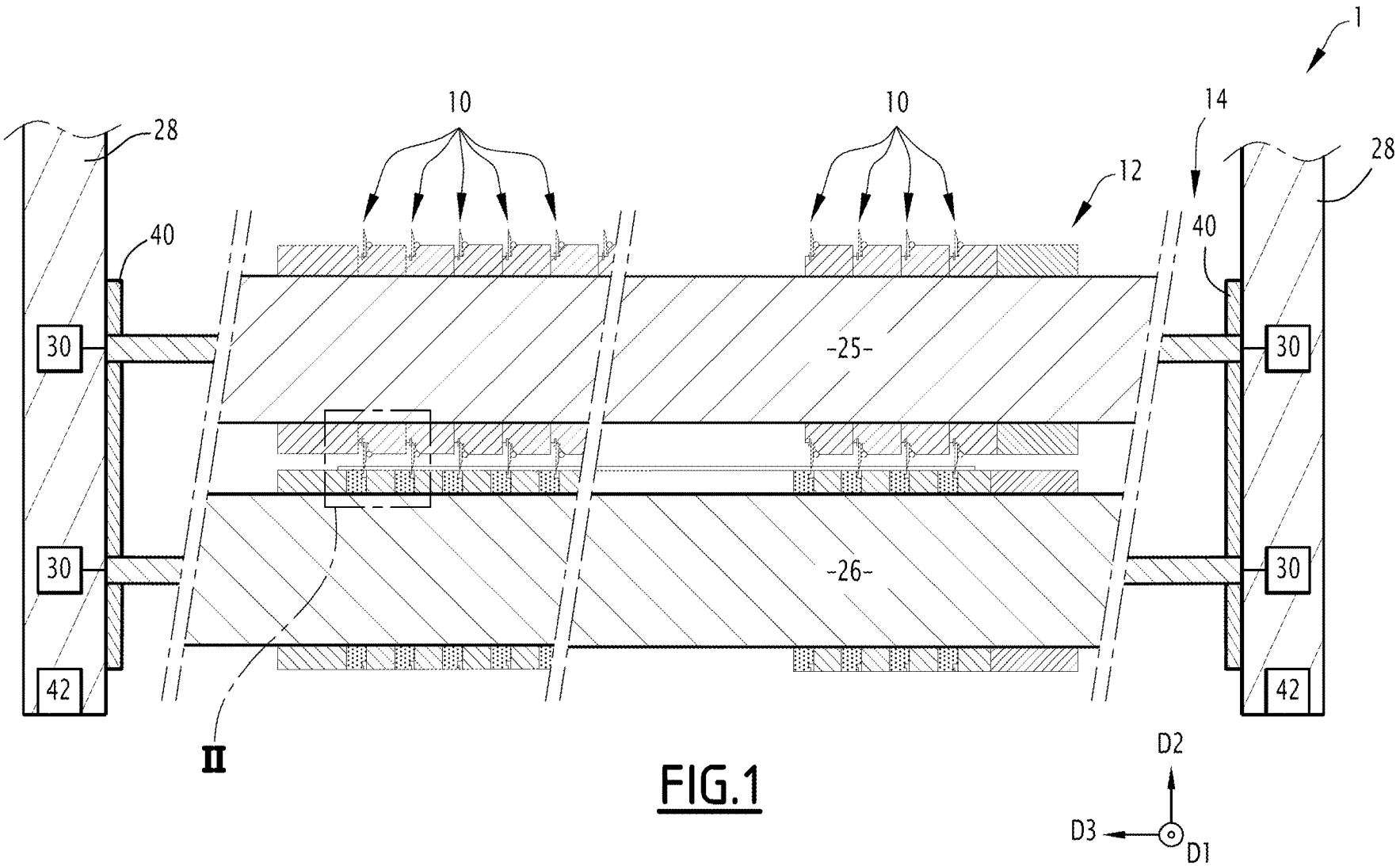

| | | | | |
|---|---|---|---|---|
| 2002/0059856 | A1* | 5/2002 | Smith | B23D 59/001 83/74 |
| 2013/0317638 | A1* | 11/2013 | Lee | B26D 5/007 700/103 |
| 2018/0079617 | A1* | 3/2018 | Oiwa | B65H 35/02 |

FOREIGN PATENT DOCUMENTS

| | | | | |
|---|---|---|---|---|
| JP | 59214610 | A * | 12/1984 | B26D 7/10 |
| JP | 2004276146 | A | 10/2004 | |

OTHER PUBLICATIONS

Search Report for International Application No. PCT/EP2019/064166 dated Sep. 3, 2019.

* cited by examiner

METHOD FOR OPTIMIZING A SHEARING BENCH AND ASSOCIATED SHEARING BENCH

CROSS-REFERENCE TO RELATED APPLICATIONS

This is the National Stage of PCT international application PCT/EP2019/064166, filed on May 31, 2019, which claims the priority of French Patent Application No. 18 54761, filed Jun. 1, 2018, both of which are incorporated herein by reference in their entirety.

The present invention relates to an optimization method for optimizing a shearing bench for shearing a film having a thickness less than or equal to 10 microns and an associated shearing bench.

Shearing benches are already known, which comprise at least one blade assembly comprising a blade and a counter-blade configured so as to shear the film. The blade and the counter-blade are typically circular blades attached to respective rollers. The film is able to pass through the shearing bench between the rollers.

However, the performance of the shearing bench in various respects not entirely satisfactory. For example, the productivity of the shearing bench as well as the product quality of the film are not optimal.

There exists therefore a need for a shearing bench that exhibits improved properties.

To this end, the present patent specification relates to an optimization method for optimizing a shearing bench for shearing a film having a thickness less than or equal to 10 microns, the shearing bench comprising a plurality of elements, each element being characterized by a plurality of parameters, the set of parameters constituting the parameters of the shearing bench, the plurality of elements comprising at least one blade assembly comprising a blade and a counter-blade that collaborates with the blade, a film progression system for progressing the film, and a blade/counter-blade urging system for urging the blade and the counter-blade against one another in order to shear the film, the method including a parameter selection step for selecting the parameters of the shearing bench, a performance measurement step for measuring the performance of the shearing bench presenting the selected parameters, so as to obtain a measured value for the shearing bench that corresponds to an evaluation criterion for evaluating the shearing bench, and a value comparison step for comparing the measured value with a desired value. When the measured value is strictly lower than the desired value, the steps of parameter selection, performance measurement, and value comparison are re-iterated by modifying at least one of the parameters selected, the at least one modified parameter being part of the parameters for each assembly of blades, the film progression system, and the blade/counter-blade urging system, until such time as the measured value is greater than or equal to the desired value, the method then including a parameter selection step for selecting the selected parameters.

According to particular embodiments, the optimization method comprises one or more of the following characteristic features, taken into consideration in isolation or in accordance with all technically possible combinations:

- the film has a first surface and a second surface opposite the first surface, the first surface is coated with at least one layer of ink;
- for each assembly of blades, the parameters are: the thickness of the blade, the material of the blade, the diameter of the blade, the geometry of the blade, the thickness of the counter-blade, the material of the counter-blade, the diameter of the counter-blade, and the geometry of the counter-blade;
- the parameters relating to the systems are as follows: the speed of rotation of each blade, the speed of rotation of each counter-blade, the pressure applied to each blade, the pressure applied to each counter-blade, the speed of progression of the film, the tension of the film, the ratio of the speed of rotation of the blade to the speed of rotation of the counter-blade, and the overlap of the blade with the counter-blade;
- the only parameters that vary from one iteration to another are the following: the thickness of each blade, the material of each blade, the thickness of each counter-blade, the material of each counter-blade, the speed of rotation of each blade, the speed of rotation of each counter-blade, and the speed of progression of the film;
- the only parameters that vary from one iteration to another are the following: the speed of rotation of each blade, the speed of rotation of each counter-blade, and the speed of progression of the film;
- the only parameters that vary from one iteration to another are the following: the shearing angle formed between each blade and the film, the overlap between each blade and the counter-blade that collaborates with the blade, the speed of rotation of each blade, the speed of rotation of each counter-blade, and the speed of progression of the film;
- the only parameters that vary from one iteration to another are the following: the shearing angle formed between each blade and the film, and the overlap between each blade and the counter-blade that collaborates with the blade;

the evaluation criterion is a weighting of the following sub-criteria: the throughput rate, the speed, fouling, the quality of the film, and the useful life of the blades;

- the weighting is such that only the sub-criteria of speed and fouling are used;
- the film progression system for progressing the film comprises a first roller and a second roller, the speed sub-criterion being determined by measuring the rotational speed of the first and second rollers, and the fouling sub-criterion being measured by means of at least an image sensor;
- the film is made of polyethylene terephthalate (PET);
- each blade comprises of a cutter comprising a cutting edge, the cutter having a parabolic shape.

The present patent specification also relates to a shearing bench for shearing a film having a thickness less than or equal to 10 microns, the shearing bench comprising a plurality of elements, each element being characterized by a plurality of parameters, the set of parameters constituting the parameters of the shearing bench, the plurality of elements comprising at least one assembly of blades comprising a blade and a counter-blade that collaborates with the blade, a film progression system for progressing the film, and a blade/counter-blade urging system for urging the blade and the counter-blade against one another in order to shear the film, the shearing bench having parameters selected by implementing an optimization method as described above.

Figure 2:
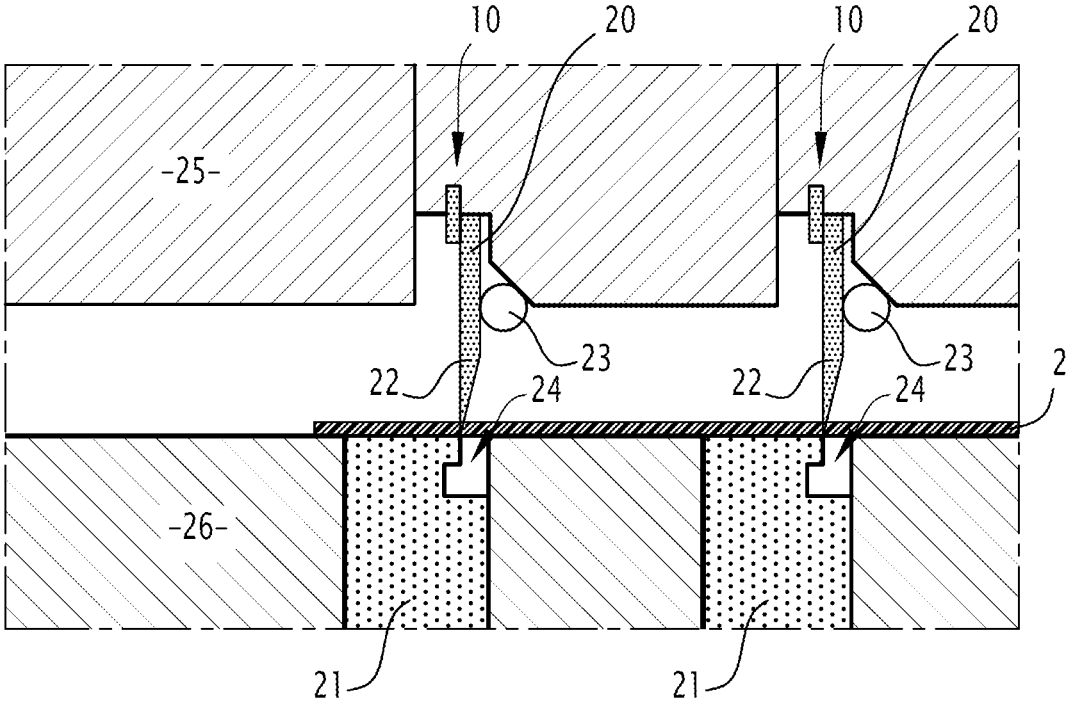
Figure 3:
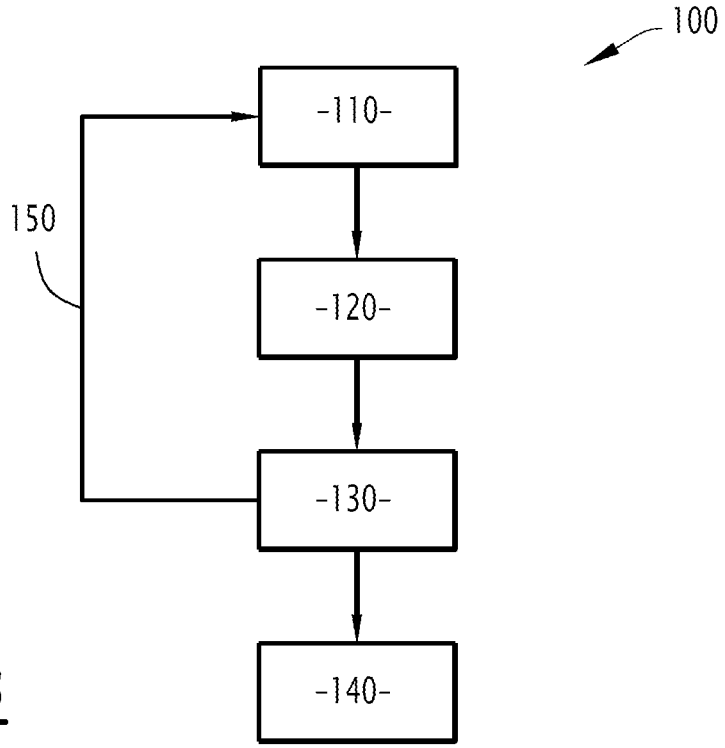

Other characteristic features and advantages of the invention will become apparent upon reading the following description of embodiments of the invention, given only by way of example and with reference to the drawings which include:

FIG. 1, a schematic cross-sectional representation of an exemplary shearing bench;

FIG. 2, a schematic cross-sectional representation of a part of the exemplary shearing bench according to FIG. 1; and FIG. 3, a flowchart schematically showing an optimization method for optimizing the shearing bench according to FIG. 1.

A shearing bench 1 for shearing a film is shown in FIG. 1. The shearing bench 1 is configured so as to shear a film 2 (visible, in particular, in FIG. 2).

In particular, the shearing bench 1 is configured so as to shear a film 2 having one or more of the following properties.

The film 2 has a thickness of between 4 and 10 microns, preferably less than or equal to 6 microns.

The film 2 is, for example, made of a polymer, for example of such type as polyamide or polyester, such as polyethylene terephthalate, or PET.

The film 2 is notably biaxially oriented. The term 'biaxially oriented', is understood to indicate that the film 2 has a first surface and a second surface opposite the first surface. The first surface is coated with at least one layer of ink which is in particular a hot melt ink. The ink layer on the first surface is intended to be transferred during printing onto a receiving medium. The receiving medium is, for example, combined/associated with an adhesive layer and/or a protective layer for protecting the ink layer of the film 2. The second surface of the film 2 is coated with at least one layer referred to as backing intended for protecting the film 2. The second surface presents in particular a slidable surface. In particular, the slidable surface enables the film progression under the print heads.

In the example provided, the film 2 has a first surface made of PET coated with a layer of ink composed of waxes, resins and at least one pigment, such as carbon black. The second surface is coated with a layer composed of silicone derivatives.

The shearing bench 1 is in particular configured so as to shear the film 2 supplied in the form of a tape designed to slide in progression along a direction of travel D1 through the shearing bench 1. In particular, the shearing bench 1 is configured so as to shear the film. 2 having a length along the direction of travel D1 of between 300 metres and 1200 metres.

For the shearing bench 1, a second direction D2 is defined which is substantially orthogonal to the direction of travel D1. In particular, the second direction is horizontal. A third direction D3 is further defined which is orthogonal to the direction of travel D1 and orthogonal to the second direction D2.

The shearing bench 1 comprises a plurality of elements. Each element is characterized by a plurality of parameters, the entire set of parameters constituting the parameters of the shearing bench 1.

In particular, the shearing bench 1 comprises at least one assembly of blades 10, a film progression system 12 for progressing the film 2 and a blade/counter-blade urging system 14 for the assembly of blades 10.

In the example of FIG. 1, nine assemblies of blades 10 are shown.

Each assembly of blades 10 comprises a blade 20 and a counter-blade 21 that collaborates with the blade 20 (visible in particular in FIG. 2).

Each blade 20 comprises of a cutter 22 comprising a cutting edge and a suspension 23 configured so as to urge the cutter 22 application against the counter-blade 21.

Each blade 20 is a circular blade. The term "circular blade" refers to a blade in the form of a circle in a plane that is perpendicular to the third direction D3. In particular, the cutting edge has a circular shape.

Each counter-blade 21 is, for example, a ring comprising a cavity 24 configured so as to receive a part of the blade 20 comprising the cutting edge. The counter-blade 21 is a circular blade.

Each assembly of blades 10 includes a plurality of technical parameters. The parameters are the technical properties of the blade 20 and the counter-blade 21.

For each assembly of blades 10, the parameters are as follows:

the thickness of the blade 20,
the material of the blade 20,
the diameter of the blade 20,
the geometry of the blade 20,
the thickness of the counter-blade 21,
the material of the counter-blade 21,
the diameter of the counter-blade 21, and
the geometry of the counter-blade 21.

The thickness of the blade 20 is defined along the third direction D3. The thickness corresponds in particular to that of the cutting edge of the blade 20 which is intended to be in contact with the film 2. For example, the thickness of the blade 20 is equal to 0.5 millimetres (mm).

The thickness of the counter-blade 21 is defined along the third direction D3. The thickness of the counter-blade 21 corresponds to the maximum thickness along the third direction D3.

The diameter of the blade 20 or the counter-blade 21 is defined along the direction of travel D1 or along the second direction D2.

The material of the blade 20 and the counter-blade 21 comprises, for example, ceramic or steel. The cutter 22 of the blade 20 comprises, for example, essentially tungsten carbide, which is preferably coated with ceramic.

The geometry of the blade 20 is in particular defined by a shearing angle formed between the blade 20 and the film 2. In the example shown, the shearing angle is substantially equal to 90 degrees.

The geometry of the blade 20 in addition comprises the shape of the cutter 22. In the example shown, the cutter 22 comprises a rectangular base that terminates in a point to form the cutting edge.

By way of a variant or an addition, the lateral movement of the blade 20 relative to the counter-blade 21 is also taken into account.

The Applicant has, by means of tests and in a surprising manner, observed that a cutter 22 comprising a parabolic shape is particularly advantageous for cutting the film 2. In particular, the thickness of the cutting edge of a cutter having a parabolic shape is lesser than the thickness of the cutting edge of a cutter having a linear shape.

Other geometries for the blade 20 may be considered.

The film 2 progression system 12 includes at least a first roller 25 having a first axis of rotation and a second roller 26 having a second axis of rotation that is substantially parallel to the first axis of rotation. The film progression system 12 in addition comprises supporting substrates 28 capable of bearing the first and second rollers 25, 26. In particular, the first and second rollers 25, 26 are movable in rotation about the first and second axis respectively relative to the supporting substrates 28.

The first roller 25 is provided with the blades 20 and the second roller 26 is provided with the counter-blades 21.

The film progression system 12 in addition comprises motors for driving the first and second rollers 25, 26.

With regard to the film progression system 12 for progressing the film 2, the parameters are as follows:

the speed of progression of the film 2, and the tension of the film 2.

The speed of progression of the film 2 is defined relative to the shearing bench 1. The film progression speed is, for example, equal to 400 metres per minute.

The tension of the film 2 corresponds to the physical force applied to the film 2 along the direction of travel D1 or along the third direction D3. For example, the force is substantially equal to 10 Newtons.

The blade/counter-blade urging system 14 is configured so as to urge the blade 20 and the counter-blade 21 application against one another in order to shear the film 2.

The blade/counter-blade urging system 14 comprises at least one roller moving device 40 for moving the first roller 25 and/or the second roller 26 and at least one controller 42.

The roller moving device 40 comprises, for example, a vertical rail on which is movably mounted in translational motion one end of the first and/or second roller 25, 26. The roller moving device 40 is configured so as to move the first roller 25 and/or the second roller 26 along the second direction D2. In addition, the roller moving device 40 is configured so as to move the first roller 25 and/or the second roller 26 along the third direction D3.

The controller 42 is, for example, a computer.

The controller 42 is in particular configured so as to send commands to the roller moving device 40 and to control the operation of the roller moving device 40.

The blade/counter-blade urging system 14 has, for example, the following technical parameters:

the speed of rotation of each blade 20, the speed of rotation of each counter-blade 21, the pressure applied to each blade 20, the pressure applied to each counter-blade 21, ratio of the speed of rotation of the blade 20 to the speed of rotation of the counter-blade 21, and the overlap of the blade 20 with the counter-blade 21.

Preferably, the speed of rotation of each blade 20 is the speed of rotation of the first roller 25, and the speed of rotation of each counter-blade 21 is the speed of rotation of the second roller 26.

The pressure applied to each blade 20 or to each counter-blade 21 is a force exerted on each blade 20 or counter-blade 21.

The pressure applied depends on a plurality of factors. For example, the pressure applied depends on the speed of rotation of the blade 20 or counter-blade 21 and the thickness of the film 2. The pressure applied is, for example, equal to 50 Newtons.

The ratio of the rotational speed of the blade 20 to the rotational speed of the counter-blade 21 is a technical parameter having an impact on the wear of blades. In particular, when the speeds are very different, the blades 20, 21 undergo greater wear. For example, the ratio is equal to 5%.

The overlap of the blade 20 with the counter-blade 21 is observed in a plane that is perpendicular to the direction of travel D1. As visible, for example, in FIG. 2, a blade portion 20 is contained in the cavity 24, that is to say, the blade 20 overlaps with the counter-blade 21.

Only the parameters used for an optimization method for optimizing the shearing bench 1 have been described. Other parameters may be taken into account.

In order to optimize the preceding parameters of such a shearing bench 1, the optimization method 100 is operationally implemented, an example of implementation being described in the section/s that follow.

The method comprises at least one parameter selection step 110, one performance measurement step 120 and one value comparison step 130.

During the parameter selection step 110, the parameters of the shearing bench 1 are selected. In particular, the parameters selected are for the assemblies of blades 10, the film progression system 12, and the blade/counter-blade urging system 14.

In a first example, the parameters are selected in random fashion, from a range of predefined values for each parameter.

In another example, each parameter is selected based on a shearing bench available on the market.

According to another example, a table of compatible parameters is defined beforehand. One parameter is selected, for example in random fashion, and the other parameters are defined by making use of the table.

Preferably, the controller 42 determines a combination of parameters. In particular, the combination of parameters comprises a large number of variants, which entails an automated definition of parameters by the controller 42.

During the performance measurement step 120, the performance of the shearing bench 1 having the selected parameters is measured.

This performance is evaluated by evaluating a plurality of physical quantities associated with the shearing bench 1.

The set of physical quantities constitutes a measured value. The measured value corresponds to an evaluation criterion. The evaluation criterion corresponds to one or more sub-criteria. The sub-criteria are, for example, the following:

the throughput rate, the speed, fouling, the quality of the film 2, and the useful life of the blades.

The sub-criterion of throughput rate is measured by determining the length of the film 2 that has passed through the shearing bench 1 during a predefined period of time. For example, the length of the film 2 that has passed through over a period of 24 hours is measured. By way of example, when the shearing bench is frequently shut down, for example for maintenance reasons, the film 2 that has passed through the shearing bench 1 is found to be of less length, other sub-criteria being kept constant.

The sub-criterion of speed is evaluated by measuring the speed of rotation of the rollers 25, 26, for example by means of a tachometer.

The sub-criterion of fouling is measured, for example, by means of at least one image sensor, such as a camera, that is in particular capable of determining residues on the blade 20 and/or the counter-blade 21.

The sub-criterion of quality of the film 2 is evaluated by taking into account one or more factors from among: the homogeneity or non-homogeneity of the thickness of the film 2, the homogeneity or non-homogeneity of the width of the film 2, the straightness or non-straightness of a cut edge of the film 2, and the fraying or non-fraying of the cut edge. For example, the sub-criterion of quality of the film 2 is evaluated by a user of the shearing bench 1 or by a control machine provided with optical control sensors.

The sub-criterion of blade useful life is evaluated by measuring the time of proper operation of the blade 20 and the counter-blade 21. The term "proper operation" is understood to indicate that the blade 10 assembly shears the film 2 according to predefined requirements in particular pertaining to the cut edge. In particular, the Applicant has noted that the useful life of the blades 20, 21 is reduced when the blades 20, 21 become heated, for example due to operating at a high speed of rotation of the blades 20, 21.

Based on the measured sub-criteria, the measured value for the shearing bench 1 that corresponds to an evaluation criterion for evaluating the shearing bench 1 is determined.

In particular, the sub-criteria are combined by applying a weighting during the performance measurement step 120.

The weighting comprises, for example, at least one multidimensional function. For example, for each sub-criterion taken into account, the function includes a functional variable. By way of example, if two sub-criteria are considered, the function includes two functional variables.

Preferably, the weighting is such that only the speed and fouling sub-criteria are used. In this example, the measured speed is a first functional variable and the measured fouling is the second functional variable. The result of the function is the measured value. At the end of the measurement step 120, the measured value is obtained.

During the value comparison step 130, the measured value is compared with a desired value.

The desired value is preferably defined beforehand prior to the implementation of the optimization method. The desired value is, for example, defined on the basis of the requirements for the shearing bench 1.

If the measured value is strictly lower than the desired value, the steps of parameter selection 110, performance measurement 120, and value comparison 130 are re-iterated, as is visible in FIG. 3 which symbolizes an iteration by the arrow 150. During an iteration, at least one of the parameters selected, from among the parameters for: each assembly of blades 10, the film progression system 12, and the blade/counter-blade urging system 14, is modified.

Preferably, the only parameters that vary from one iteration to another are the following:

the thickness of each blade 20,
the material of each blade 20,
the thickness of each counter-blade 21,
the material of each counter-blade 21,
the speed of rotation of each blade 20,
the speed of rotation of each counter-blade 21, and
the speed of progression of the film 2.

The selection of these parameters as the only parameters is unexpected and results from the work carried out by the Applicant. In particular, the selection provides the ability to reduce the number of parameters to be modified, while, at the same time, making it possible to obtain various performance improvements in the shearing bench 1.

Preferably, the only parameters that vary from one iteration to another iteration are the following:

the speed of rotation of each blade 20,
the speed of rotation of each counter-blade 21,
the speed of progression of the film 2, and
the shearing angle formed between the blade 20 and the film 2.

By definition, the shearing angle between the blade 20 and the film 2 is the angle between the normal to the film 2 and the position of the blade 20.

The preceding parameters are known as main parameters in the following section/s.

The modification of the main parameters makes it possible to further simplify the optimization method 100.

It has been noted that the main parameters are the parameters that have the greatest impact on the performance of the shearing bench 1 from among the parameters for: the assemblies of blades 10, the film progression system 12, and the blade/counter-blade urging system 14.

In particular, it has been noted that the main parameters involve the varying of other parameters from among the set of parameters for: the assemblies of blades 10, the film progression system 12, and the blade/counter-blade urging system 14. As a consequence, a variation of the main parameters, at the same time, enables the varying of other parameters.

For example, the speed of progression of the film 2 is linked to the pressure applied to each blade 20 and to the pressure applied to each counter-blade 21, in particular due to the fact that the assembly of blades 10 cuts, over a considered period of time, a greater length of film 2 if the film progression speed 2 is increased.

The steps 110, 120 and 130 are preferably re-iterated until such time as the measured value is greater than or equal to the desired value.

If the measured value is greater than or equal to the desired value, a parameter selection step 140 is implemented.

During the selection step 140, the parameters selected during the latest preceding iteration I of the optimization method 100 are selected for the operation of the shearing bench 1.

The optimization method 100 for optimizing the shearing bench 1 has a plurality of advantages.

The reduction in the parameters, for example over the main parameters, makes it possible to achieve satisfactory results with respect to the operation of the shearing bench 1, and at the same time, to limit the complexity of optimization.

Such a reduction in parameters is specific to the cases of inked ribbons.

Indeed, only the parameters that control the contact of the blades 20 and counter-blades 21 are involved.

In addition, due to the nature of the film 2 to be sheared, the sub-criteria are preferably specific since only speed and fouling are used.

In particular, the geometry of the films 2 obtained is not taken into account.

The optimization method 100 thus makes it possible to obtain the desired performance levels in the shearing bench 1. Thanks to the optimization method 100, a shearing bench 1 demonstrating enhanced properties is thus obtained.

In particular, in manual use, the shearing bench 1 has a maximum speed of 500 metres per minute (the speed is restricted), a useful life of the blades 20/counter-blades 21 of between 5 and 8 million linear metres and makes it possible to obtain 4000 linear metres per hour.

In the case of automated use, the values are even higher. The shearing bench 1 has a maximum speed of between 800 metres per minute and 900 metres per minute, a useful life of the blades 20/counter-blades 21 greater than or equal to 10 million linear metres and makes it possible to obtain 10,000 linear metres per hour.

In both cases, there is no fouling. Only simple traces are observed, which does not impact the shearing that can thus continue.

In addition, the overall equipment effectiveness, also referred to as OEE, defined as the ratio between the number of metres produced with the shearing bench 1 and the number of metres that it would theoretically be possible to produce with the shearing bench 1 is equal to 85%.

A combination of the preceding embodiments when technically possible may also be envisaged.

The invention claimed is:

1. An optimization method for optimizing a shearing bench for shearing a film having a thickness less than or equal to 10 microns, the shearing bench comprising a plurality of elements having a plurality of element parameters that constitute bench parameters of the shearing bench, the plurality of elements comprising:

at least one blade assembly, each blade assembly comprising a blade and a counter-blade that collaborates with the blade, a film progression system for progressing the film, and a blade/counter-blade urging system for urging the blade and the counter-blade of each blade assembly against one another in order to shear the film, the method including the steps of:

selecting bench parameters of the shearing bench;

measuring performance of the shearing bench presenting the selected bench parameters, so as to obtain a measured value; and comparing the measured value with a desired value;

wherein when the measured value is strictly lower than the desired value, the steps of selecting, measuring, and comparing are re-iterated by modifying at least one of the selected parameters at each iteration until the measured value at one iteration is greater than or equal to the desired value, and wherein either:

the only bench parameters that vary from one iteration to another are:

a speed of rotation of each blade, a speed of rotation of each counter-blade, a speed of progression of the film, a thickness of each blade, a material of each blade, a thickness of each counter-blade, and a material of each counter-blade, or the only bench parameters that vary from one iteration to another are:

the speed of rotation of each blade, the speed of rotation of each counter-blade, the speed of progression of the film, a shearing angle formed between each blade and the film, and an overlap between the blade and counter-blade of each blade assembly, and wherein the selected bench parameters at the last iteration are optimized parameters of the shearing bench.

2. The optimization method according to claim 1, wherein the film has a first surface and a second surface opposite the first surface, the first surface being coated with at least one layer of ink.

3. The optimization method according to claim 1, wherein each blade assembly includes the following element parameters:

the thickness of the blade, the material of the blade, a diameter of the blade, a geometry of the blade, the thickness of the counter-blade, the material of the counter-blade, a diameter of the counter-blade, and a geometry of the counter-blade.

4. The optimization method according to claim 1, wherein the shearing bench includes the following element parameters:

the speed of rotation of each blade, the speed of rotation of each counter-blade, a pressure applied to each blade, a pressure applied to each counter-blade, the speed of progression of the film, tension of the film, the ratio of the speed of rotation of each blade to the speed of rotation of the counter-blade that collaborates with the blade, and the overlap of the blade and counter-blade of each blade assembly.

5. The optimization method according to claim 1, in which the only bench parameters that vary from one iteration to another are:

the thickness of each blade, the material of each blade, the thickness of each counter-blade, the material of each counter-blade, the speed of rotation of each blade, the speed of rotation of each counter-blade, and the speed of progression of the film.

6. The optimization method according to claim 1, wherein the only bench parameters that vary from one iteration to another are:

the shearing angle formed between each blade and the film, the overlap between the blade and counter-blade of each blade assembly, the speed of rotation of each blade, the speed of rotation of each counter-blade, and the speed of progression of the film.

7. The optimization method according to claim 1, wherein the only bench parameters that vary from one iteration to another are:

the shearing angle formed between each blade and the film, and the overlap between the blade and counter-blade of each blade assembly, such that the speed of rotation of each blade, the speed of rotation of each counter-blade, and the speed of progression of the film remain constant from one iteration to another.

8. The optimization method according to claim 1, in which the measured value is based on a weighting of the following sub-criteria:

a throughput rate of the shearing bench, a speed parameter of the shearing bench, fouling, a quality of the film, and a useful life of the blade of each blade assembly.

9. The optimization method according to claim 8, wherein the weighting is such that only the sub-criteria of fouling and the speed parameter of the shearing bench are used.

10. The optimization method according to claim 8, wherein the film progression system for progressing the film comprises a first roller and a second roller, wherein the speed parameter of the shearing bench is determined by measuring a rotational speed of the first and second rollers, and wherein the fouling is measured by means of at least an image sensor.

11. The optimization method according to claim 1, wherein the film is made of polyethylene terephthalate.

* * * * *